US007634878B1

(12) United States Patent
Motosko

(10) Patent No.: US 7,634,878 B1
(45) Date of Patent: Dec. 22, 2009

(54) HURRICANE PANEL LOCKING SYSTEM

(76) Inventor: Stephen J Motosko, 132 Sand Dollar La., Sarasota, FL (US) 34242

( * ) Notice: Subject to any disclaimer, the term of this patent is extended or adjusted under 35 U.S.C. 154(b) by 423 days.

(21) Appl. No.: 11/601,000

(22) Filed: Nov. 17, 2006

(51) Int. Cl.

| | |
|---|---|
| ***E05B 15/00*** | (2006.01) |
| ***E05B 65/46*** | (2006.01) |
| ***E05B 65/08*** | (2006.01) |
| ***E05C 19/08*** | (2006.01) |
| ***E05C 19/18*** | (2006.01) |
| ***E05C 19/00*** | (2006.01) |

(52) U.S. Cl. ..... 52/202; 70/2; 70/5; 70/6; 70/7; 70/8; 70/89; 70/90; 292/281; 292/289; 52/203

(58) Field of Classification Search ..... 70/2–7, 70/89, 90; 292/281, 289, 300, 338, 342, 292/343; 52/202, 203
See application file for complete search history.

(56) References Cited

U.S. PATENT DOCUMENTS

| | | | | |
|---|---|---|---|---|
| 4,333,271 | A | 6/1982 | DePaolo et al. | |
| 4,613,175 | A * | 9/1986 | Nelson | 292/148 |
| 4,685,261 | A | 8/1987 | Seaquist | |
| 4,777,809 | A * | 10/1988 | Wiggins | 70/57 |
| 6,079,168 | A | 6/2000 | Shaver | |
| 6,205,713 | B1 | 3/2001 | Thompson et al. | |
| 6,209,263 | B1 * | 4/2001 | Poirier | 49/61 |
| 6,532,702 | B1 | 3/2003 | Scribner | |
| 6,617,532 | B1 * | 9/2003 | Turek | 200/43.14 |
| 6,886,294 | B1 | 5/2005 | Carey | |
| 6,910,312 | B2 | 6/2005 | Whitworth | |
| 6,928,843 | B1 * | 8/2005 | Pirnie | 70/54 |
| 6,978,579 | B1 * | 12/2005 | Trinca | 52/203 |
| 7,069,700 | B2 * | 7/2006 | Heissenberg | 52/202 |
| 7,131,300 | B1 * | 11/2006 | Monasco | 70/55 |
| 2005/0193651 | A1 | 9/2005 | Kirk | |
| 2005/0211396 | A1 | 9/2005 | Doiron et al. | |

* cited by examiner

*Primary Examiner*—Brian E Glessner
*Assistant Examiner*—Omar Hijaz
(74) *Attorney, Agent, or Firm*—Charles J. Prescott

(57) ABSTRACT

A locking mechanism for a hurricane panel installation protectively covering a window of a building, the panel installation including a panel member sized to cover the window, a header attached to the building above the window for securing an upper edge of the panel member, and a lower F-track attached to the building below the window which supports attaching bolts which pass through and secure a lower edge of the panel member. The locking mechanism includes a padlock having a hasp securely positionable in a hasp receiving arrangement to prevent substantial movement of the lower edge of the panel member and unauthorized removal of the panel member.

2 Claims, 8 Drawing Sheets

HURRICANE PANEL LOCKING SYSTEM

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to hurricane shutters and panels for protecting window and door openings in a building during the threat of a hurricane or tropical storm and more particularly to a locking system which secures such hurricane panels in place from unauthorized entry into the building.

2. Description of Related Art

Hurricane shutters and panels for building openings are well known and represent a substantial improvement in both deployment and effectiveness over simply boarding over doors and windows with plywood sheets. Although plywood is effective in protecting buildings from window breakage and further damage thereafter, these plywood sheets are heavy and difficult to install and block out virtually all light from entering into the building. Many newer hurricane panel structures are either translucent or transparent and are much lighter and easier to install on relatively short notice in the face of a hurricane threat.

Both during a hurricane threat and thereafter, many buildings and homes are left empty caused by mandatory evacuations during the hurricane threat. Boarded up doors and windows present a very visible unintended notice to vandals and burglars that the building is likely temporarily uninhabited and, by the simple removal of conventional hurricane panels or plywood, access into the empty building is an easy certainty.

U.S. Published Patent Application US2005/0193651 teaches a shutter assembly for storm and security protection, one embodiment of the assembly consisting of translucent panels enclosed within the upper and lower track of a housing and comprising a locking mechanism. U.S. Pat. No. 6,205,713 to Thompson, et al. teaches hurricane protection for windows and doors comprising a shutter with hardware and a locking rod mechanism with padlock.

U.S. Pat. No. 6,532,702 to Scribner teaches safeguarding a building from vandals or storms comprising panel members and spring loaded locking inserts. Storm resistant fixed shutter assemblies are taught by Carey in U.S. Pat. No. 6,886,294 and Whitworth discloses a storm brace assembly in U.S. Pat. No. 6,910,312.

The present invention provides in two alternate embodiments an effective means for locking hurricane panels in place so that unlocking a conventional padlock is required to effect their removal. No additional hardware or building or hurricane shutter modification is needed to effect installation and use of the present invention which adds to its versatility and economy.

BRIEF SUMMARY OF THE INVENTION

This invention is directed to a locking mechanism for a hurricane shutter or panel installation which protectively covers a window of a building, the panel installation including a panel member sized to cover the window, a header attached to the building above the window for securing an upper edge of the panel member, and a lower F-track attached to the building below the window which supports attaching bolts which pass through and secure a lower edge of the panel member. The locking mechanism includes a padlock having a hasp securely positionable in alternate hasp receiving arrangement which prevents all substantial movement of the lower edge of the panel member and unauthorized removal of the panel member.

It is therefore an object of this invention to provide a locking system for hurricane panels and shutters which renders them non-removable except through opening access of a padlock.

Still another object of this invention is to provide a hurricane panel and shutter locking system which is easily accessible for the unlocking and removal of hurricane panels on a temporary basis during hurricane threats.

Yet another object of this invention is to provide a hurricane panel and shutter locking system which is easily installable and deployable without further modification to the hurricane shutter or building or window structure.

In accordance with these and other objects which will become apparent hereinafter, the instant invention will now be described with reference to the accompanying drawings.

BRIEF DESCRIPTION OF THE SEVERAL VIEWS OF THE DRAWING(S)

DETAILED DESCRIPTION OF THE INVENTION

Figure 1:
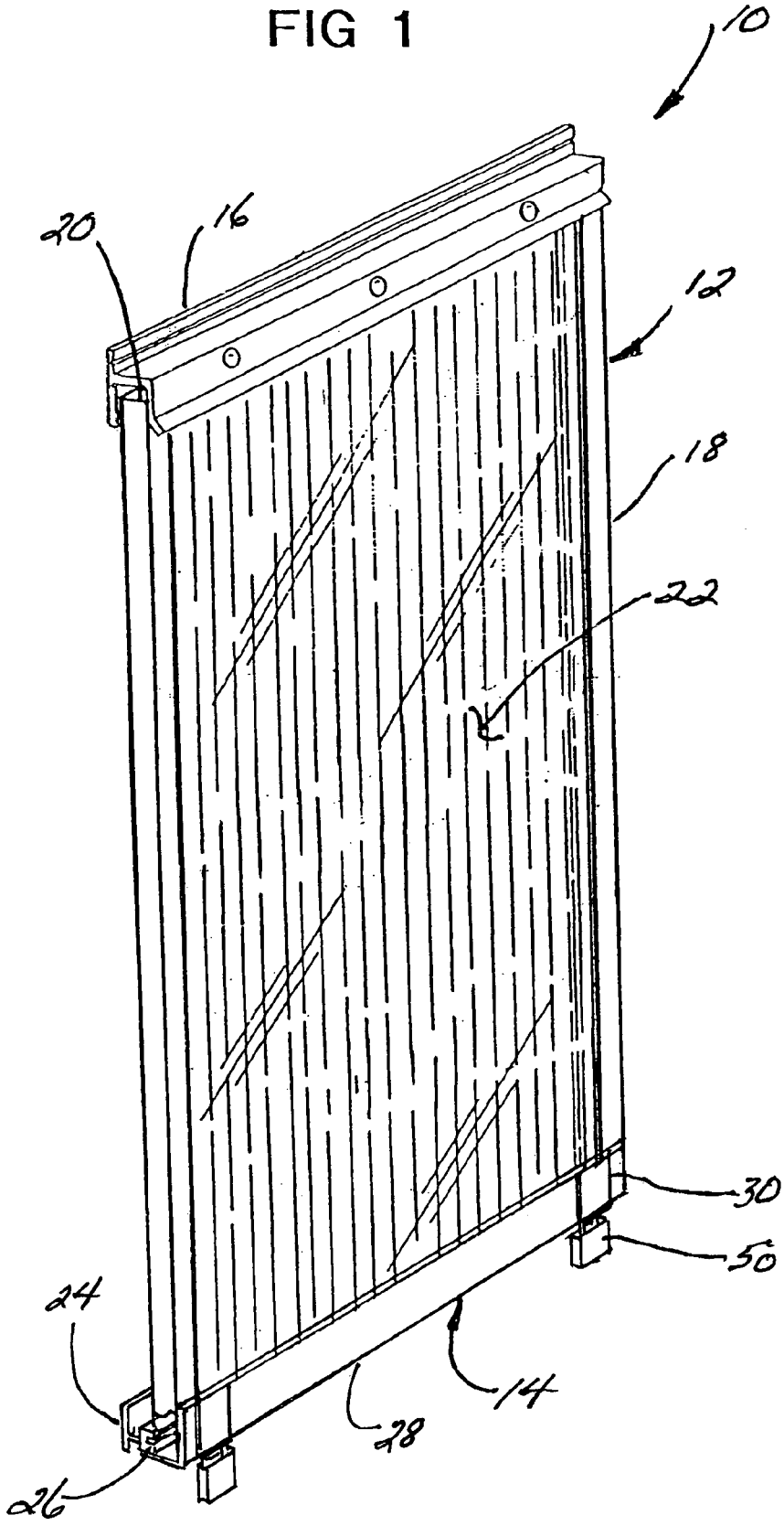
FIG. 1 is a perspective view of a hurricane shutter lockably secured in place by one embodiment of the invention.

Referring now to the drawings, two embodiments of the invention are there presented at 14 and 54 in FIGS. 1 to 3 and FIGS. 4 to 11, respectively. Both of these embodiments 14 and 54 are adapted to lockably prevent any substantial outward or downward movement of the deployed hurricane panel member 18 or 58, respectively, which would otherwise provide unauthorized access into the building through the protected window (not shown for clarity).

Figure 2:
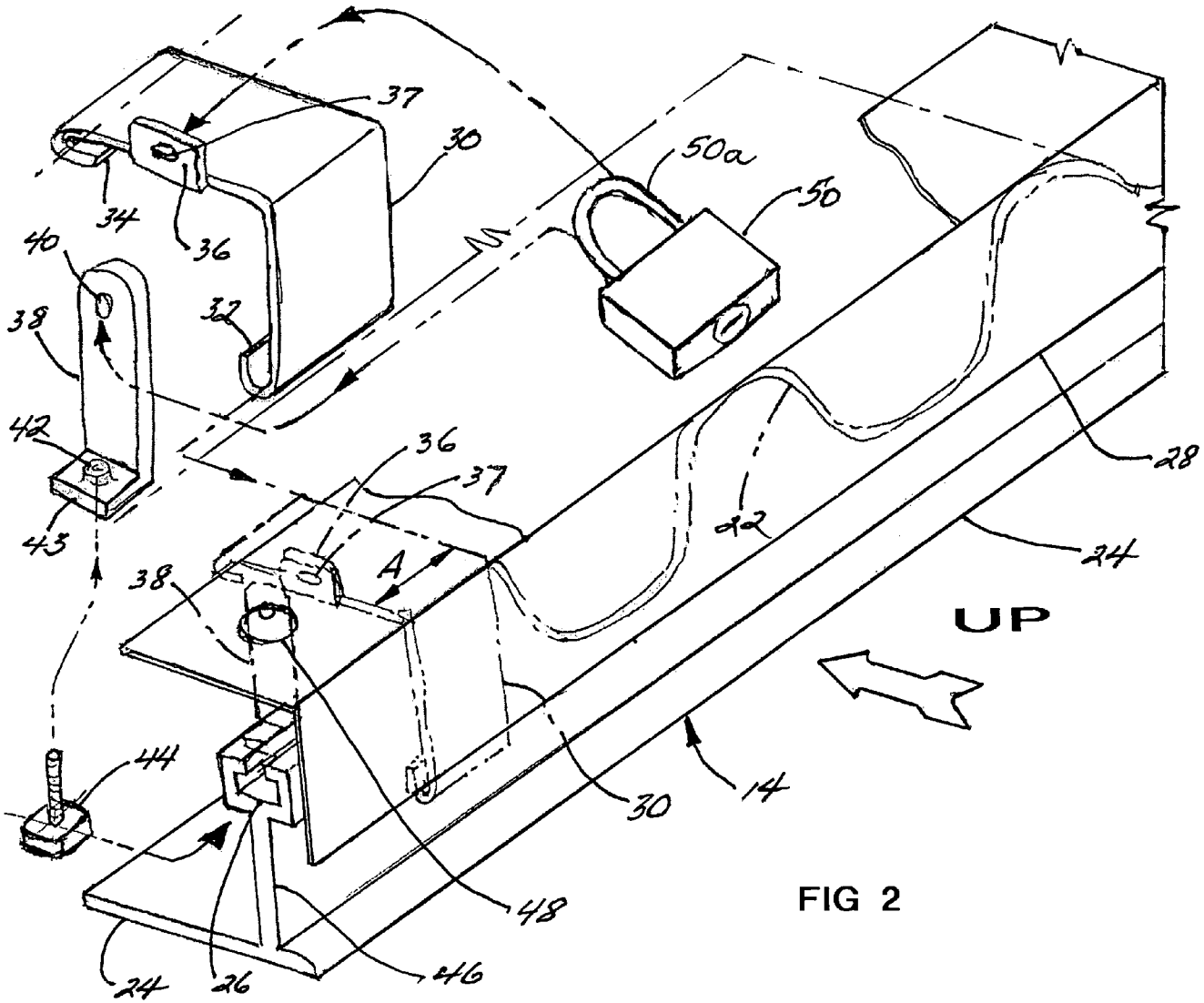
FIG. 2 is an exploded perspective broken view of the embodiment of the invention of FIG. 1.
Figure 3:
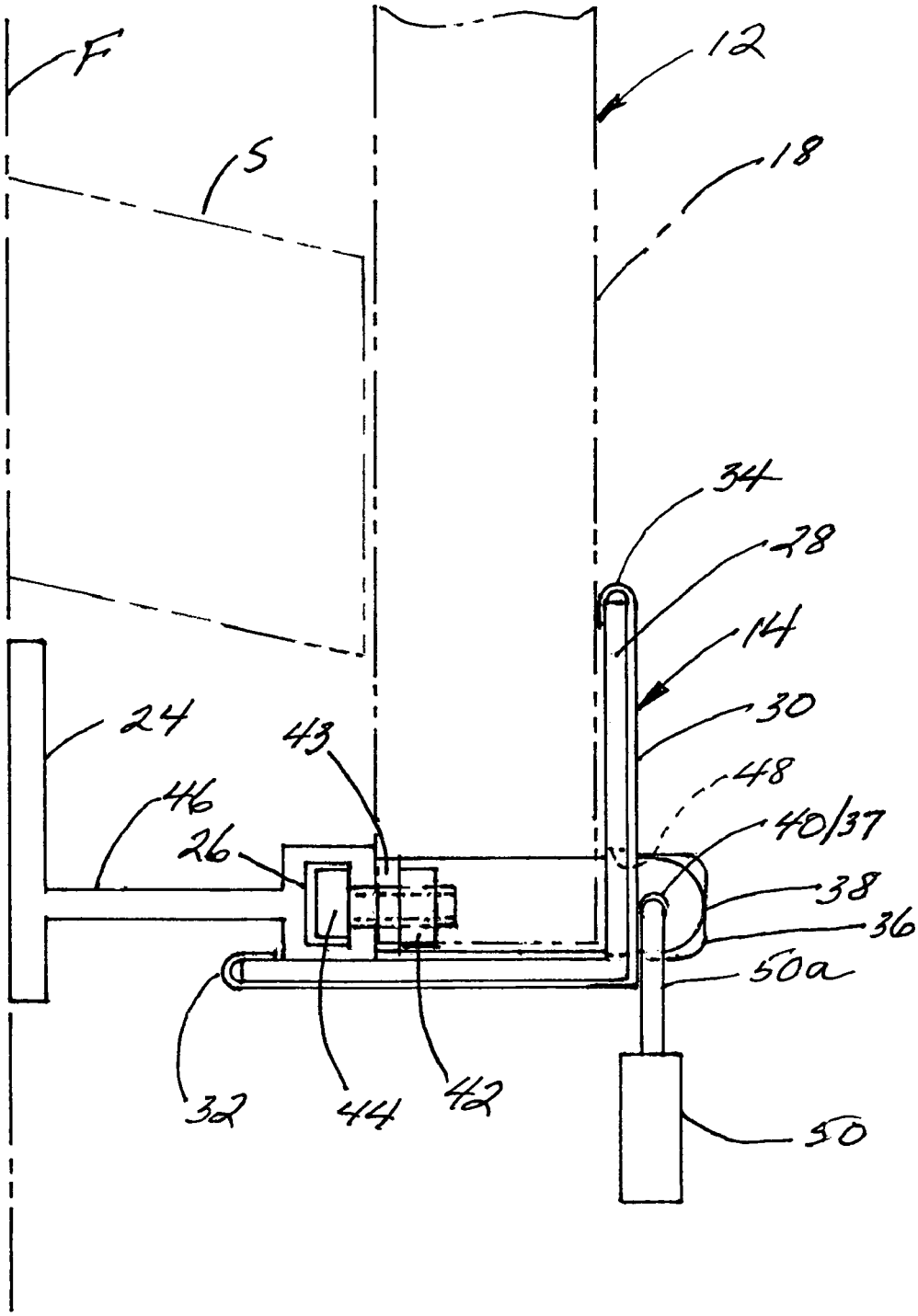
FIG. 3 is a side elevation view of the invention disposed at the lower end of the hurricane panel installation of FIG. 1.
Figure 4:
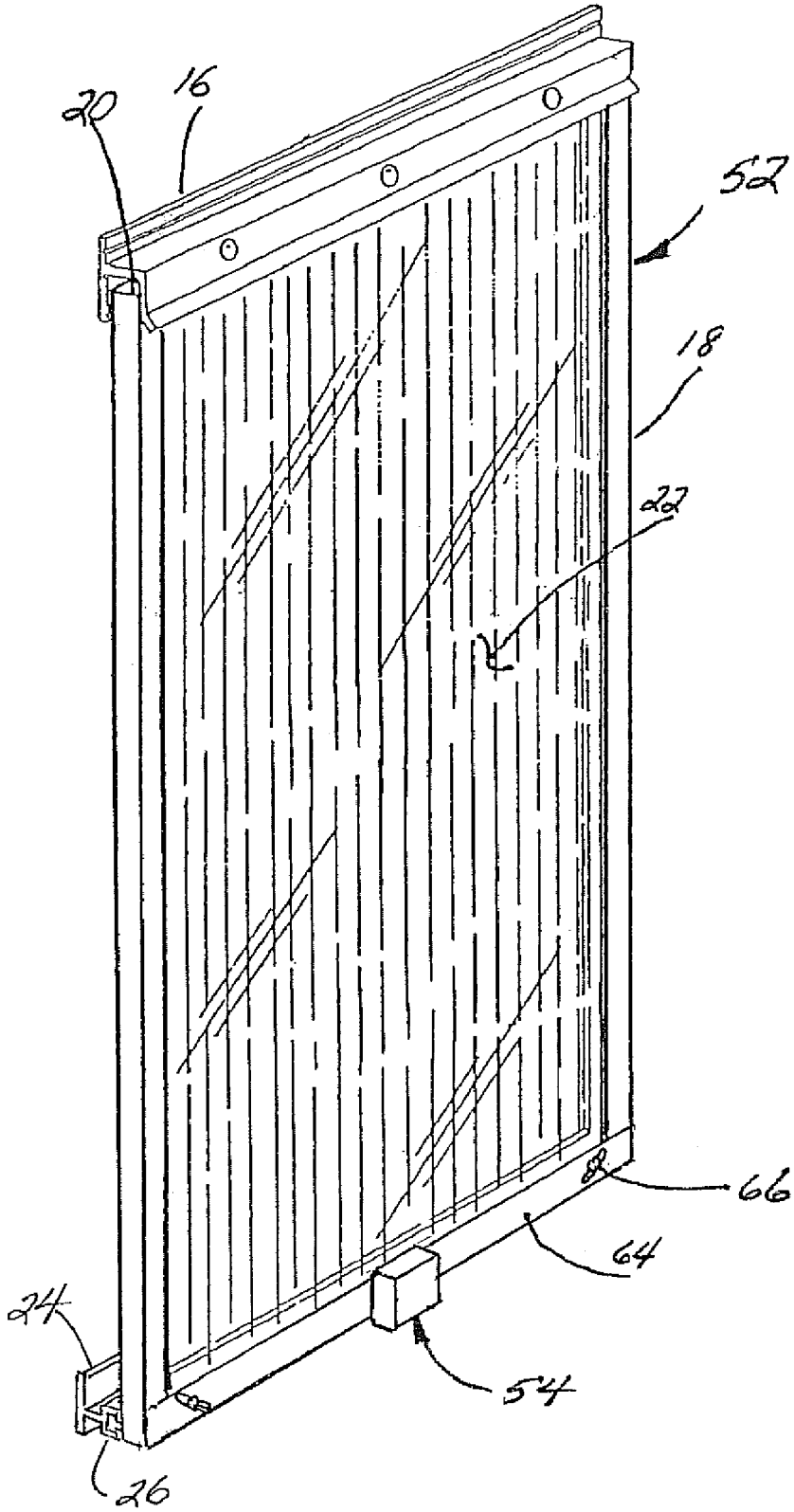
FIG. 4 is a perspective view of a hurricane panel installation showing another embodiment lockingly securing it in place.
Figure 5:
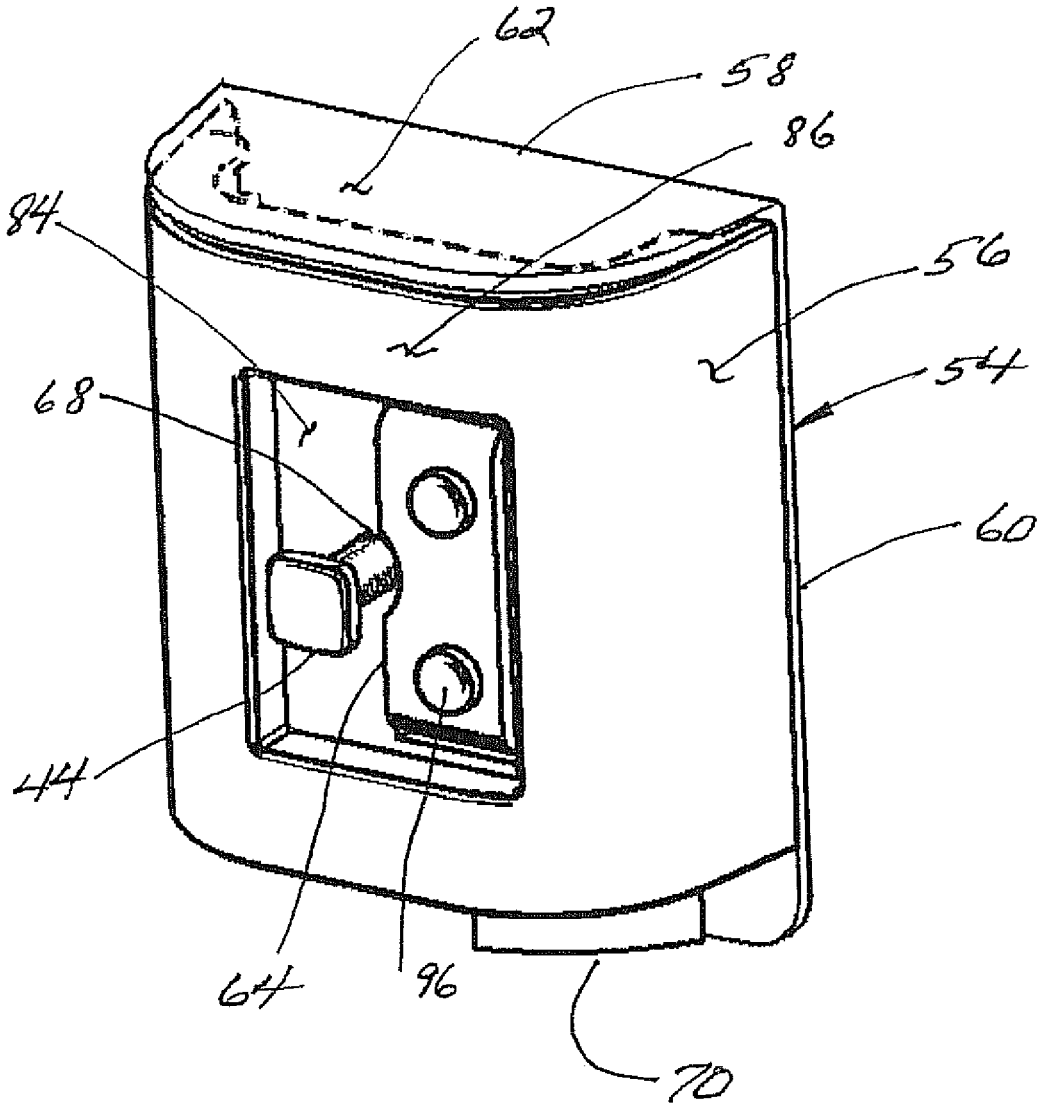
FIG. 5 is a perspective view of the locking mechanism of FIG. 4.
Figure 6:
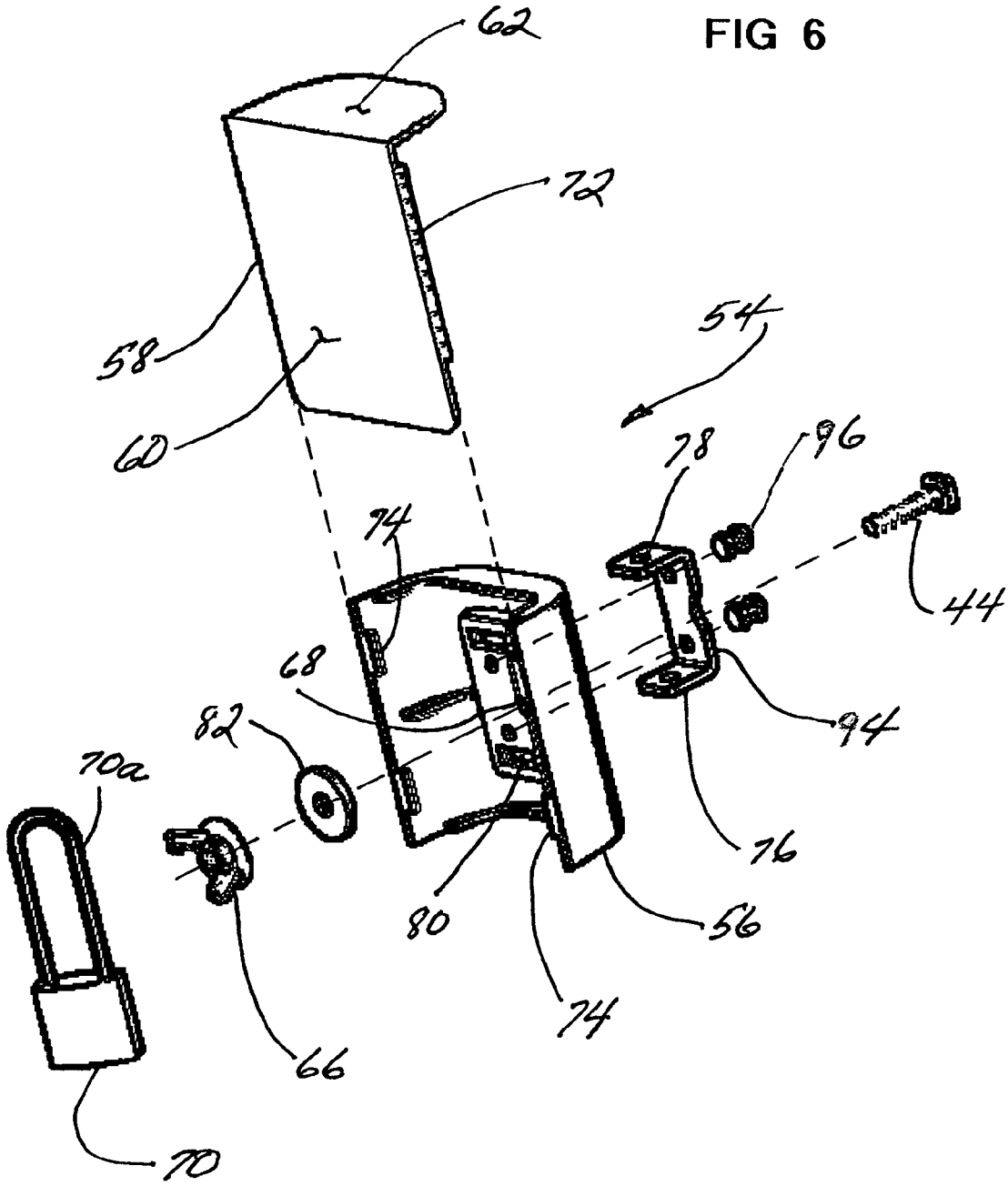
FIG. 6 is an exploded perspective view of FIG. 5.

Referring specifically to the embodiment 14 shown in FIGS. 1 to 3, a conventional hurricane shutter installation is there shown generally at numeral 10 in FIG. 1. A hurricane panel or shutter member 12 typically includes a corrugated polycarbonate sheet 22 held within a frame 18. The upper end 20 of this frame 18 is entrapped within a downwardly U-shaped header 16 which is attached to a building just above the window or directly to the window frame itself. As best understood from FIGS. 1 and 3, the lower edge of the panel member 12 is secured in place utilizing an elongated aluminum extruded F-track 24 which slidably supports square-headed s.s. attaching bolts 44 having their threaded shank outwardly extending from a channel 26 of the F-track 24, the channel or track 26 spaced from the building wall F in accordance with the length of web 46 of the F-track 24. Note that the length of the web 46 of each of the F-tracks 24 has been previously sized to accommodate the outward extension of a windowsill S as seen in FIG. 3. The corrugated panel member 22 and/or frame 18 having mating and aligned holes with the shank of attaching bolt 44 is thus secured by threadably engaging a conventional wing nut (not shown) against the outer surface of the panel 22 or frame 18. By this conventional means for hurricane panel attachment, easy access to the wing nuts is made available for easy unauthorized removal of the panel member from over the window which is being protected by the hurricane panel.

The locking mechanism embodiment 14 includes an elongated aluminum angle bar 28 which is sized in length to be generally coextensive with the lower edge of the panel member 12. The orientation of this angle bar 28 as best seen in FIG. 3, positions one leg thereof against the outer surface of the frame 18 with the other leg horizontally disposed immediately beneath the lower downwardly facing edge of the panel member 18.

Preferably two L-brackets 38 are also provided, a short leg 43 of which includes a threaded embossment 42, while a longer leg of the L-bracket includes a hole or aperture sized to receive a hasp 50*a* of a conventional padlock 50 as best seen in FIG. 3. Each of the L-brackets 38 is threadably securable against the outwardly facing surface of channel 26 of the elongated F-track 24 by attaching bolts 44. The threaded shank of the attaching bolt 44 threadably engages into the threaded embossment 43 preferably by rotation of the L-bracket 38 to prevent inadvertent removal of a conventional threaded nut by wrench access after installation is completed.

Two L-shaped sliders 30, one for each of the L-brackets 38, also have a generally L-shaped configuration with edge-entrapping U-shaped flanges 32 and 34 formed at the distal ends of each of the legs of each slider 30. Each flange is sized and shaped to snugly slidably engage over the corresponding edge of angle bar 28 as shown by arrow A in phantom in FIG. 2. Each of these sliders 30 also includes an outturned flange 36 also having a hasp-receiving hole 37 formed therethrough.

After each L-bracket 38 is secured in place onto the corresponding attaching bolt 44 as previously described, a hole or slot 48 formed adjacent each end of the angle bar 28 is fitted over the outwardly extending leg 38 so that it passes through the hole 48 as best seen in FIGS. 2 (in phantom) and 3. With the angle bar 28 positioned against the outer face of the panel member 18 so that the distal portion of each of the L-brackets 38 extends outwardly through each hole 48, the sliders 30 may be moved in an appropriate direction A so that tab 36 bears against the exposed mating surface of the L-bracket 38, after which the hasp 50*a* of the conventional padlock 50 is passed through the mating holes 40/37 and secured in place by the locking of the padlock 50. By this arrangement, no substantial movement of the panel member 18 is possible on an unauthorized basis by a potential intruder unless substantial portions of this entire arrangement are destroyed, a task which most intruders do not relish.

Referring now to FIGS. 4 to 11, another embodiment of the invention is there shown at numeral 54 in conjunction with another typical hurricane panel or shutter installation 52. The hurricane panel member 52 which typically includes a transparent or translucent corrugated polycarbonate sheet 22 held within a frame 18 is entrapped at the upper frame edge 20 within the downwardly or inverted U-shaped header 16 attached directly above the window to a building surface as previously described. The lower edge 64 of the panel member 52 is typically attached to an F-track 24 as previously described, which is itself attached immediately below the window to the building or window frame surface.

Square-headed s.s. attaching bolts 44 as previously described slidably engage within the channel 26 of the F-track 24, again as previously described. The threaded shanks of each of these attaching bolts 44 outwardly extend through the lower edge 64 of the frame 18 and are secured in place by wing nuts 66 threadably engaged thereover and against the outer surface of this lower edge 64. Again, an intruder achieves easy unauthorized access into the building by the simple removal of the wing nut 66 and thus the easy removal of the frame 18.

To prevent such unauthorized access, this embodiment 54 of the invention is generally configured to prevent disengaging rotation of at least one of the wing nuts 66. A molded plastic housing 56 has a central mounting aperture 68 centrally positioned and formed through a recessed back panel 84 of housing 56. An elongated U-shaped bracket 94 having hasp-receiving aligned apertures formed into offset legs 76 and 78 is secured by rivets 96 into slots 80 also formed through the central housing within recess 84 such that the offset legs 76 and 78 pass outwardly or away from the mounting surface 86 which bears against the lower outwardly facing surface of the lower edge 64 of the frame 18.

Figure 7:
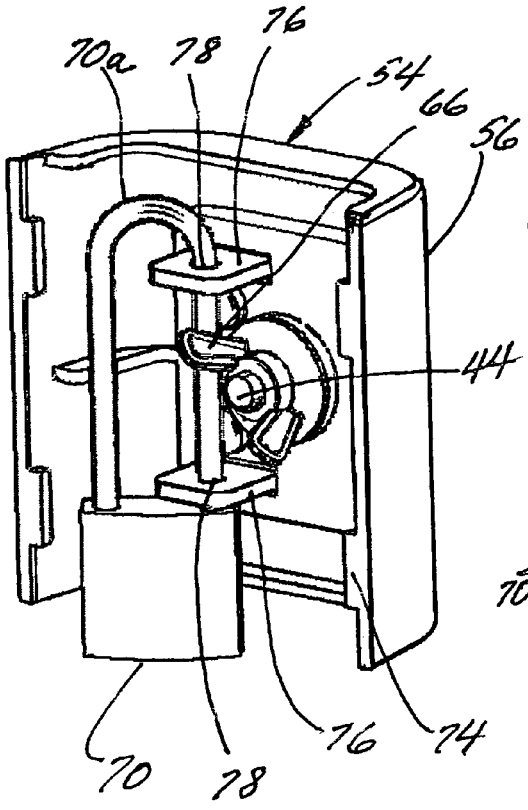
FIGS. 7 and 8 are front perspective views of the embodiment of the invention of FIG. 4 with the access cover removed.
Figure 8:
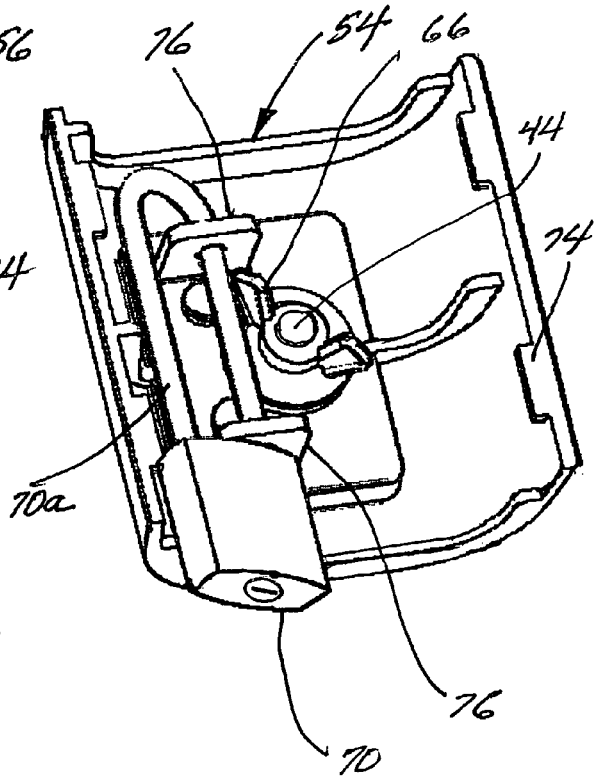
Figure 9:
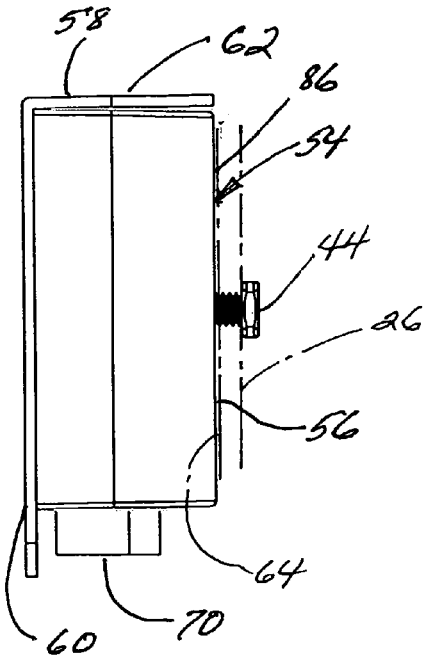
FIG. 9 is a side elevation view of FIG. 5.
Figure 10:
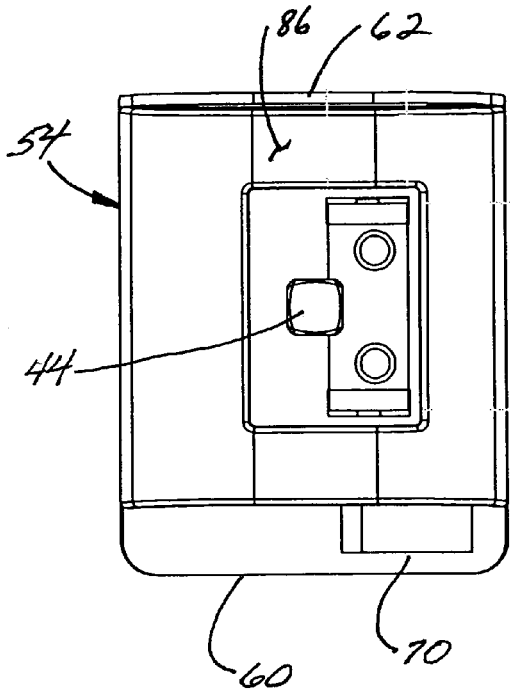
FIG. 10 is a rear elevation view of FIG. 9.
Figure 11:
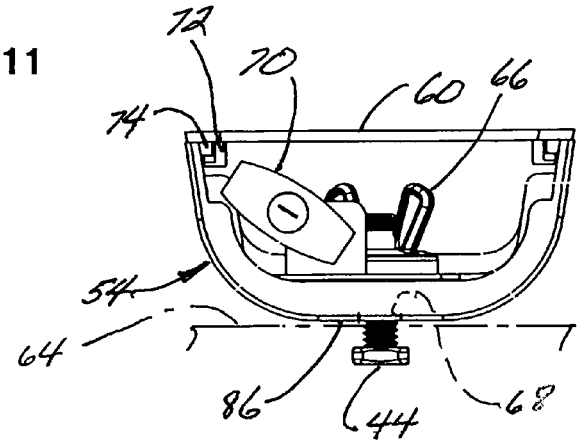
FIG. 11 is a bottom plan view of FIG. 10.

To secure the housing 56 over the threaded shank of attaching bolt 44 outwardly extending from the mounting aperture 68, a conventional wing nut 66 is threadably engaged thereover bearing against washer 82 to secure the housing 56 in place. The key element to this locking mechanism 54 is facilitated by an elongated hasp 70*a* which is engageable through the aligned hasp-receiving apertures of the legs 76 and 78 which are positioned immediately adjacent to the mounting holes 68 such that at least one leg of the hasp 70*a* as best seen in FIGS. 7 and 8, bear against at least one wing of the wing nut 66 to prevent meaningful rotation of the wing nut 66 and thus to prevent unauthorized removal of the frame 18.

A molded plastic mating weather cover 58 is also generally L-shaped in cross sectional configuration and includes U-shaped tracks 72 which slidably receive mounting tabs 74 disposed along the edges of housing 56 as best seen in FIGS. 6, 7, 8 and 11. This weather cover 58 includes a back panel 60 which substantially covers over and downwardly extends somewhat from the length of the housing 56 and also includes a top plate 62 which overlaps an inwardly turned upper flange of housing 56 to prevent substantial weather access to the attaching bolt 44, wing nut 66 bracket 64 and padlock 70.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

The invention claimed is:

1. In a hurricane panel installation protectively covering a window of a building, the panel installation including a panel member sized to cover the window, a header attached to the building above the window for securing an upper edge of the panel member, and a lower F-track attached to the building below the window which supports a plurality of spaced attaching bolts which passing through a lower edge of the panel member, the lower edge being securable in place by threaded engagement of a wing nut onto each of the attaching bolts, the improvement comprising:

a housing having a central mounting aperture formed through a back panel thereof for receiving a threaded shank of one of the attaching bolts outwardly extending through said aperture when said housing is positioned over the one attaching bolt against an outer surface of, and along a lower edge of the panel member;

said housing being held in place against the lower outer surface of the panel member by one of the wing nuts threadably tightened in place over the shank of the attaching bolt against an outer facing surface of said back panel;

a U-shaped hasp receiving bracket attached to said housing adjacent to said mounting aperture and having spaced legs which extend outwardly from said back panel;

a padlock having an elongated hasp securely positionable through aligned hasp receiving apertures formed through said legs;

one side of said hasp bearing against said wing nut to prevent substantial rotation of said wing nut and unauthorized removal of the panel member thereby.

2. A locking mechanism for a hurricane panel installation protectively covering a window of a building, the panel installation including a panel member sized to cover the window, a header attached to the building above the window for securing an upper edge of the panel member, and a lower F-track attached to the building below the window which supports a plurality of spaced attaching bolts which passing through a lower edge of the panel member, the lower edge being securable in place by threaded engagement of a wing nut onto each of the attaching bolts, the locking mechanism comprising:

a housing having a central mounting aperture formed through a back panel thereof for receiving a threaded shank of one of the attaching bolts outwardly extending through said aperture when said housing is positioned over the one attaching bolt against an outer surface of, and along a lower edge of the panel member;

said housing being held in place against the lower outer surface of the panel member by one of the wing nuts threadably tightened in place over the shank of the attaching bolt against an outer facing surface of said back panel;

a U-shaped hasp receiving bracket attached to said housing adjacent to said mounting aperture and having spaced legs which extend outwardly from said back panel;

a padlock having an elongated hasp securely positionable through aligned hasp receiving apertures formed through said legs;

one side of said hasp bearing against said wing nut to prevent substantial rotation of said wing nut to prevent unauthorized removal of the panel member.

* * * * *